United States Patent [19]

Fonte

[11] 4,137,995

[45] Feb. 6, 1979

[54] POLE CLIMBING APPARATUS

[76] Inventor: Frank Fonte, 406 S. Habana, Tampa, Fla. 33609

[21] Appl. No.: 857,003

[22] Filed: Dec. 2, 1977

[51] Int. Cl.[2] ..... A47C 9/10; A63B 27/02

[52] U.S. Cl. ..... 182/135; 182/187; 182/136

[58] Field of Search ..... 182/187, 133-136, 182/188

[56] References Cited

U.S. PATENT DOCUMENTS

| | | | |
|---|---|---|---|
| 3,485,320 | 12/1969 | Jones | 182/187 |
| 3,856,111 | 12/1974 | Baker | 182/187 |
| 3,944,022 | 3/1976 | Ming | 182/187 |
| 3,960,240 | 6/1976 | Cotton | 182/187 |

*Primary Examiner*—Reinaldo P. Machado
*Attorney, Agent, or Firm*—Arthur W. Fisher, III

[57] ABSTRACT

A pole climbing apparatus for use in installation and repair of telephone lines and the like comprising an upper work platform and a lower climbing platform wherein the upper work platform includes an upper base plate for positioning substantially horizontally against a pole having a first upper pole engaging element formed on the inner portion thereof and a second upper pole engaging element coupled to the upper base plate by an upper interconnecting element comprising a pair of substantially parallel upper interconnecting members extending from the midportion of opposite sides of the upper base plate to opposite sides of the second upper pole engaging element and the lower climbing platform includes a lower base plate for positioning substantially horizontally against the pole below the upper work platform having a first lower pole engaging element formed on the inner portion of the lower base plate and a second lower pole engaging element coupled to the lower base plate by a lower interconnecting element comprising a pair of substantially parallel lower interconnecting members extending from the mid-portion of opposite sides of the lower base plate to opposite sides of the second lower pole engaging element, the lower climbing platform further including feet engaging elements formed on the lower base plate to secure the operator's feet thereto whereby the operator stands up on the lower climbing platform raising the upper work platform with his arms to separate the upper work platform and lower climbing platform relative to each other and then while seated on the upper work platform raises his feet lifting the lower climbing platform toward the upper work platform successively to adjust the elevation of the upper work platform relative to the pole.

9 Claims, 3 Drawing Figures

POLE CLIMBING APPARATUS

BACKGROUND OF THE INVENTION

1. Field of the Invention

A pole climbing apparatus for use in the installation and repair of telephone lines and the like comprising an upper work platform and a lower climbing platform.

2. Description of the Prior Art

A number of tree or pole climbing devices are found in the prior art. For example, U.S. Pat. No. 3,856,111 shows a hand-climber-accessory for tree-climbing platforms for hunters and a horizontal base plate having a tree engaging blade. Angularly disposed frame members extend from the base plate to support a second blade or strap to engage the opposite side of the tree. The hand-climber accessory is positioned on the tree above the platform and includes parallel bars to engage the tree. Blades are attached to the bars to engage the tree. A hunter standing on the base plate alternately adjusts the elevation of the hand-climber accessory with respect to the base plate and raises or lowers the base plate by lifting and lowering his feet to first disengage and reengage the platform with respect to the tree at a different elevation.

An earlier patent U.S. Pat. No. 3,460,649 disclosed a similar climbing platform having a base plate positioned against the pole or tree. The operator places his arms around the pole or and pulls his feet upwardly to climb the pole or tree by raising the plate with respect to the pole or tree.

U.S. Pat. No. 3,955,645 discloses another hand-held climbing device in combination with a standing platform for climbing a tree by lifting his body with his feet in foot straps on the platform. This pivots the platform away from the tree so that the platform may be slipped up into a new position. When the platform is then pressed against the tree, it will be held in place so that the hand-held climbing device may then be pivoted upward to release and shimmied up the tree.

U.S. Pat. No. 3,485,320 illustrates a device for climbing a tree by this approximate method. The upper framework is shimmied up the tree against the force of a series of elastic vertical straps attached between the frame and a lower platform. The framework is then pivoted against the tree to lock it in place and the weight of the person is supported on the upper framework with the feet being raised so that the elastic straps may pivot the lower platform away from the tree to release it and raise it up the tree. When the person then places his weight again on the bottom platform, this pivots the platform against the tree to lock it in place whereby the upper framework may then be raised by the person's hands to release it from the tree and shimmy it further up. A series of these actions will raise the platform and the person up the tree to a selected position.

U.S. Pat. No. 3,419,108 discloses a portable tree stand engaging a tree and held in place by means of a series of spikes on the platform.

U.S. Pat. No. 2,392,538 and U.S. Pat. No. 2,842,300 show pivoting frameworks with a strap to engage a tree, the entire arrangement being moved upwardly by pivoting free from the tree and shimming up the tree under hand power.

The combination of hand-held pole grippers and foot operated pole grippers are shown in U.S. Pat. No. 213,715. Additional constructions for tree stand and climbing devices are shown in U.S. Pat. Nos. 758,200; 857,430; 1,106,098; 1,307,468; 2,174,525; 2,654,638; 3,237,720; 3,340,961; 3,606,315; 3,727,723; 3,944,022; and 4,008,785.

However none show a pair of working platforms using leg power to position the apparatus vertically on the pole or tree.

SUMMARY OF THE INVENTION

The present invention relates to a pole climbing apparatus for use in the installation and repair of telephone lines and the like comprising an upper work platform and lower climbing platform.

More particularly, the upper work platform comprises an upper base plate including a first upper pole engaging element and a second upper pole engaging element coupled to the upper base plate by an upper interconnecting element to position the upper work platform in a substantially horizontal position when in use.

The upper base plate comprises a seat member while the first upper pole engaging element comprises a crossbar element in fixed spaced relation relative to the seat member to cooperatively form a leg opening therebetween and a substantially U- or V-shaped first upper pole engaging means.

The second upper pole engaging element comprises a substantially U- or V-shaped second upper pole engaging means. Each upper interconnecting means includes a plurality of apertures formed on the outer portion thereof to receive coupling elements attached to the second upper pole engaging element to permit lateral adjustment thereof to facilitate use of the pole climbing apparatus with poles or trees of various diameters. When in use, upright support members fixedly support the second upper pole engaging element diagonally upward relative to the first upper pole engaging element.

The lower climbing platform is similarly constructed. Specifically the lower climbing platform comprises a lower base plate including a first lower pole engaging element formed on the inner portion thereof and a second lower pole engaging element coupled to the lower base plate by a lower interconnecting element comprising a pair of substantially parallel lower interconnecting members to position the lower climbing platform in a substantially horizontal position when in use.

The lower base plate comprises a foot support member having a pair of feet engaging elements. The feet engaging elements each comprise foot holds and adjustable straps to cooperatively secure the operator's feet to the lower climbing plate when in use. The first lower pole engaging element comprises a substantially U- or V-shaped first lower pole engaging means.

The second lower pole engaging element comprises a substantially U- or V-shaped second lower pole engaging means. Each lower interconnecting means includes a plurality of apertures formed on the outer portion thereof to receive coupling elements attached to the second lower pole engaging element to permit lateral adjustment thereof to facilitate use of the pole climbing apparatus with poles or trees of various diameters. When in use upright support members fixedly support the second lower pole engaging element diagonally upward relative to the first lower pole engaging element.

In use, the upper working platform and lower climbing platform are secured to the pole or tree. The operator then places his legs through the leg aperture and secures his feet to the lower climbing platform by feet engaging elements. The operator then stands up while lifting the upper work platform to porvide maximum vertical separation between the upper work platform and lower climbing platform. While seated on the upper work platform the operator raises his legs lifting the lower climbing platform upwardly to reduce the vertical separation between the two platforms. This process is continued until the desired vertical height on the pole is reached. Once in place the operator may sit on the upper work platform. Of course, as necessary or desired the operator may also stand on the lower climbing platform during use. Thus the operator is able to freely manuever while working on the pole. To descend the pole, the operation is simply reversed.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
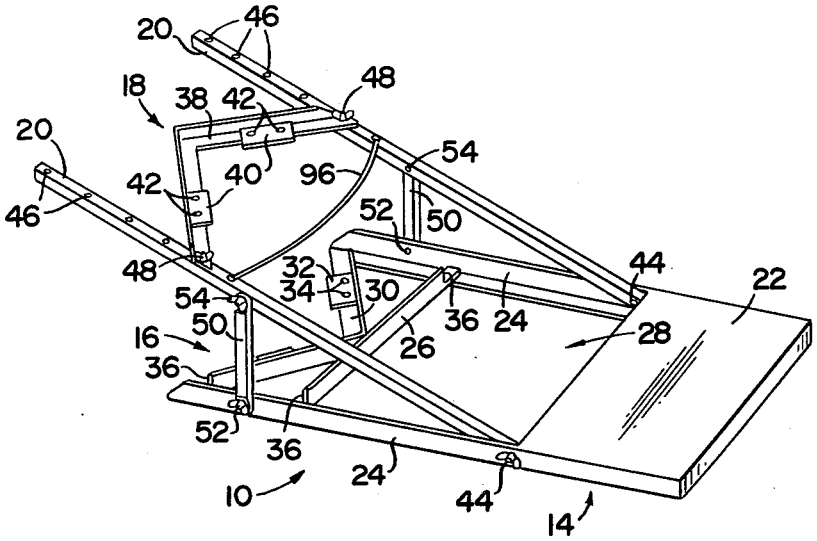
FIG. 1 is a perspective view of an upper working platform.
Figure 2:
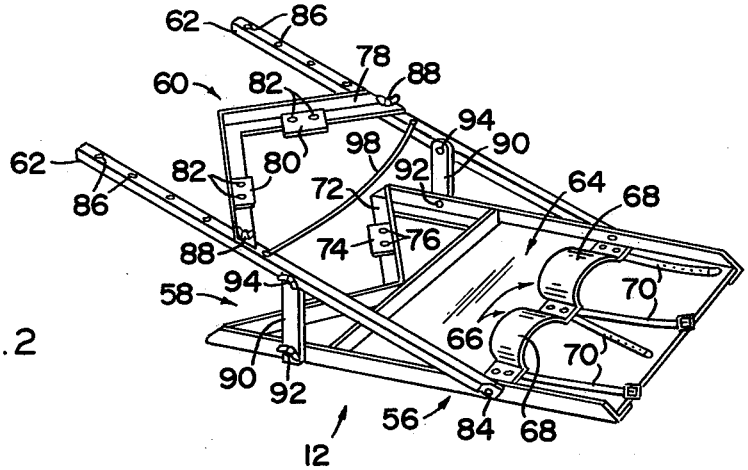
FIG. 2 is a perspective view of a lower climbing platform.
Figure 3:
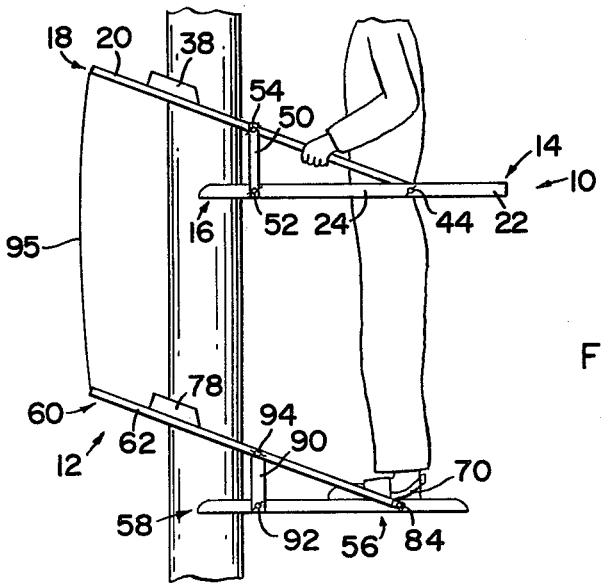
FIG. 3 is a side view of a pole climbing apparatus in use.

As shown in FIGS. 1 through 3 the present invention relates to a pole climbing apparatus for use in the installation and repair of telephone lines and the like comprising an upper work platform and lower climbing platform 10 and 12 respectively.

As best shown in FIGS. 1 and 3, the upper work platform 10 comprises an upper base plate generally indicated as 14 including a first upper pole engaging element generally indicated as 16 formed on the inner portion thereof and a second upper pole engaging element generally indicated as 18 coupled to the upper base plate 14 by an upper interconnecting element comprising a pair of substantially parallel upper interconnecting members each indicated as 20 to position the upper work platform 10 in a substantially horizontal position when in use.

As best shown in FIG. 1, the upper base plate 14 comprises a seat member 22 having a pair of substantially parallel side frame members each indicated as 24 extending outwardly from opposite sides thereof. The first upper pole engaging element 16 comprises a cross-bar element 26 extending between the side frame members 24 in fixed spaced relation relative to the seat member 22 to cooperatively form a leg opening 28 therebetween and a substantially U- or V-shaped first upper pole engaging means 30 having a pair of blade elements 32 removable attached thereto by fastner means 34. The cross-bar element 26 further includes channels 36 formed on opposite ends thereof to accommodate the substantially parallel upper interconnecting members 20 when the upper work platform 10 is in the folded position as more fully described hereinafter.

As best shown in FIG. 1, the second upper pole engaging element 18 comprises a substantially U- or V-shaped second upper pole engaging means 38 having a pair of blade elements 40 removable attached thereto by fastner means 42. Each upper interconnecting means 20, pivotally attached to the side frame members 24 by fastner means 44, such as wing nuts immediately forward of seat member 22 includes a plurality of apertures 46 formed on the outer portion thereof to receive coupling elements 48 attached to the second upper pole engaging element 18 to permit lateral adjustment thereof to facilitate use of the pole climbing apparatus with poles or trees of various diameters. Of note is the location of fastner means 44 to balance the pivot movement of the upper work platform 10 during use. Since the upper interconnecting members 20 are pivotally coupled to the side frame members 24, the second upper pole engaging element 18 may be collapsed such that the interconnecting means 20 may register with channels 36 for storage. When in use, upright support members 50, detachably coupled to side members 24 by fastner means 52 and pivotally attached to the upper interconnecting members 20 by fastner means 54, fixedly support the second upper pole engaging element 18 diagonally upward relative to the first upper pole engaging element 16. It is envisioned that the removable blade elements 32 and 40 may comprise metal or hard rubber type knife edges, serrated elements or friction pressure pads which permits selective use on poles constructed of various material.

The lower climbing platform 12 is similarly constructed. Specifically as best shown in FIGS. 2 and 3, the lower climbing platform 12 comprises a lower base plate generally indicated as 56 including a first lower pole engaging element generally indicated as 58 formed on the inner portion thereof and a second lower pole engaging element generally indicated as 60 coupled to the lower base plate 56 by a lower interconnecting element comprising a pair of substantially parallel lower interconnecting members each indicated as 62 to position the lower climbing platform 12 in a substantially horizontal position when in use.

As best shown in FIG. 2, the lower base plate 56 comprises a foot support member 64 having a pair of feet engaging elements each generally indicated as 66. Feet engaging elements 66 each comprise foot holds 68 fixedly attached to the upper surface of foot support member 64 and adjustable straps 70 to cooperatively secure the operator's feet to the lower climbing plate 12 when in use. The first lower pole engaging element 58 comprises a substantially U- or V-shaped first lower pole engaging means 72 having a pair of blade elements 74 removable attached thereto by fastner means 76.

As best shown in FIG. 2, the second lower pole engaging element 60 comprises a substantially U- or V-shaped second lower pole engaging means 78 having a pair of blade elements 80 removable attached thereto by fastner means 82. Each lower interconnecting means 62, pivotally attached to the foot support member 64 by fastner means 84, includes a plurality of apertures 86 formed on the outer portion thereof to receive coupling elements 88 attached to the second lower pole engaging element 60 to permit lateral adjustment thereof to facilitate use of the pole climbing apparatus with poles or trees of various diameters. Of note is the location of fastner means 84 to balance the pivot movement of the lower climbing platform 12 during use. It should be noted that the feet engaging elements 66 are attached to the mid-portion of the foot support member 64 such that the forward portion of the operator's feet are in line with the pivot point. Since the lower interconnecting members 62 are pivotally coupled to the foot support member 64, the second lower pole engaging element 60 may be collapsed for storage. When in use upright support members 90, detachably coupled to the foot support member 64 by fastner means 92 and pivotally attached to the lower interconnecting member 62 by fastner means 94, fixedly support the second lower pole engaging element 60, diagonally upward relative to the first lower pole engaging element 58. It is envisioned that the removable blade elements 74 and 80 may comprise metal or hard rubber type knife edges, serrated elements or friction pressure pads which permits selective use on poles constructed of various materials.

As shown in FIG. 3, the pole climbing apparatus further includes a safety interlock means comprising a flexible coupling element 95 attached between at least one upper interconnecting member 20 and at least one lower interconnecting member 62. As shown in FIG. 1, the upper work platform 10 includes an upper safety lock 96 comprising a resilient member coupled between the substantially parallel upper interconnecting members 20 to hold the second upper pole engaging element 18 against the pole when in use. As shown in FIG. 2, the lower climbing platform 12 includes a lower safety lock 98 comprising a resilient member coupled between the substantially parallel lower interconnecting members 62 to hold the second lower pole engaging element 60 against the pole when in use.

In use, the upper working platform 10 and lower climbing platform 12 are secured to the pole or tree as shown in FIG. 3. Specifically upper and lower interconnecting members 20 and 62 respectively are passed on opposite sides of the pole and then the second upper and second lower pole engaging elements 18 and 60 respectively are secured to the upper work platform 10 and lower climbing platform 12 respectively as previously described.

The operator then places his legs through leg aperture 28 and secures his feet to the lower climbing platform 12 by feet engaging elements 66. The operator then stands up while lifting the upper work platform 10 to provide maximum vertical separation between the upper work platform 10 and lower climbing platform 12. While seated on the upper work platform 10, the operator raises his legs lifting the lower climbing platform 12 upwardly to reduce the vertical separation between the two platforms 10 and 12. This process is continued until the desired vertical height on the pole is reached. Once in place the operator may sit on the upper work platform 10. Of course, as necessary or desired the operator may sit on the upper work platform 10. Of course, as necessary or desired the operator may also stand on the lower climbing platform 12 during use. Thus the operator is able to freely manuever while working on the pole. It should be noted that the upper work platform 10 may be used to attach various work implements and tools within easy reach of the operator without additional equipment. Moreover, since the operator used his legs to climb, minimum effort is expended. To descend the pole, the operation is simply reversed.

The pole climbing apparatus further includes a safety interlock means comprising a flexible coupling element 94 attached between at least one upper interconnecting member 20 and at least one lower interconnecting member 62. As shown in FIG. 1, the upper work platform 10 includes an upper safety lock 96 comprising a resilient member coupled between the substantially parallel upper interconnecting members 20 to hold the second upper pole engaging element 18 against the pole when in use. As shown in FIG. 2, the lower climbing platform 12 includes a lower safety lock 98 comprising a resilient member coupled between the substantially parallel lower interconnecting members 62 to hold the second lower pole engaging element 60 against the pole when in use.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A pole climbing apparatus for use in the installation and repair of telephone lines and the like comprising an upper work platform and a lower climbing platform, said upper work platform includes an upper base plate having a seat member held in fixed spaced relation relative to a first upper pole engaging element by a pair of substantially parallel side frame members to cooperatively form a leg opening therebetween and a second upper pole engaging element coupled to said upper base plate by an upper interconnecting element comprising a pair of substantially parallel upper interconnecting members extending from opposite sides of said upper base plate to opposite sides of said second upper pole engaging element, said upper work platform further includes an upper safety lock comprising a resilent member coupled between said substantially parallel upper interconnecting members to secure said second upper pole engaging element against the pole when in use, said lower climbing platform includes a lower base plate having a foot support member formed thereon and a first lower pole engaging element formed on the inner portion of said lower base plate and a second lower pole engaging element coupled to said lower base plate by a lower interconnecting element comprising a pair of substantially parallel lower lower interconnecting members extending from opposite sides of said lower base plate to opposite sides of said second lower pole engaging element, said lower climbing platform further including feet engaging elements formed on said foot support member to secure the operator's feet thereto whereby the operator stands on said lower climbing platform raising said upper work platform with his arms to separate said upper work platform and lower climbing platform vertically relative to each other and then while seated on said upper work platform raises his feet lifting the lower climbing platform toward said upper work platform successively to adjust the elevation of said upper work platform relative to the pole.

2. The pole climbing apparatus of claim 1 wherein said pair of substantially parallel upper interconnecting members are pivotally attached at one end thereof to said side frame members immediately forward of said seat member.

3. The pole climbing apparatus of claim 1 wherein said substantially parallel upper interconnecting members each includes a plurality of apertures formed on the outer portion thereof to receive coupling elements formed on said second upper pole engaging element to permit lateral adjustment of said second upper pole engaging element relative to said upper base plate and wherein said substantially parallel lower interconnecting members include a plurality of apertures formed thereon the outer portions thereof to receive coupling elements formed on said second lower pole engaging element to permit lateral adjustment of said second lower pole engaging element relative to said lower base plate.

4. The pole climbing apparatus of claim 1 wherein said first upper pole engaging element comprises a first upper pole engaging means including blade elements detachably formed thereon and said second upper pole engaging element comprises a second upper pole engaging means including blade elements detachably formed thereon and wherein said first lower pole engaging element comprises a first lower pole engaging means including blade elements detachably formed thereon and wherein said second lower pole engaging element comprises a second lower pole engaging means including blade elements detachably formed thereon.

5. The pole climbing apparatus of claim 1 wherein said feet engaging elements comprise a pair of foot holds fixedly attached to the upper surface of said foot support member and a corresponding pair of adjustable straps operatively attached to each said foot hold to cooperatively secure the operator's feet to said lower climbing platform when in use.

6. The pole climbing apparatus of claim 5 wherein said substantially parallel lower interconnecting members are pivotally attached to said lower base plate adjacent said pair of foot holds.

7. The pole climbing apparatus of claim 1 wherein said lower climbing platform further includes a lower safety lock comprising a resilent member coupled between said substantially parallel lower interconnecting members to secure said second lower pole engaging element against the pole when in use.

8. The pole climbing apparatus of claim 1 further including a safety interlock means coupled between said upper work platform and said lower climbing platform to operatively couple said upper work platform and said lower climbing platform to each other during use.

9. The pole climbing apparatus of claim 8 wherein said safety interlock means comprises a flexible coupling element attached between at least one of said upper interconnecting members and at least one of said lower interconnecting members.

* * * * *